US008540795B2

(12) United States Patent
Carpenter et al.

(10) Patent No.: US 8,540,795 B2
(45) Date of Patent: Sep. 24, 2013

(54) ROTARY CUTTER KNIFE

(75) Inventors: Michael Carpenter, Warwickshire (GB); Bart De Bruyne, Gluiras (FR); Daniel Tartavez, Seyssins (FR); Jean Parjat, Epinouze (FR)

(73) Assignee: Sandvik Intellectual Property AB, Sandviken (SE)

( * ) Notice: Subject to any disclaimer, the term of this patent is extended or adjusted under 35 U.S.C. 154(b) by 731 days.

(21) Appl. No.: 12/640,965

(22) Filed: Dec. 17, 2009

(65) Prior Publication Data

US 2010/0154607 A1 Jun. 24, 2010

(30) Foreign Application Priority Data

Dec. 18, 2008 (SE) ..... 0802614

(51) Int. Cl.
*C22C 29/08* (2006.01)
*B26D 1/00* (2006.01)
*B26D 3/22* (2006.01)

(52) U.S. Cl.
USPC ..... 75/240; 83/13; 83/663

(58) Field of Classification Search
USPC ..... 75/240; 83/13, 663
See application file for complete search history.

(56) References Cited

U.S. PATENT DOCUMENTS 3,993,446 A * 11/1976 Okawa ..... 75/240
4,497,660 A * 2/1985 Lindholm ..... 75/240
5,223,020 A * 6/1993 Kolaska ..... 75/238
5,305,840 A * 4/1994 Liang et al. ..... 175/426
5,902,942 A * 5/1999 Maderud et al. ..... 75/240
6,368,377 B1 * 4/2002 Bryant et al. ..... 75/240
6,524,364 B1 * 2/2003 Ederyd ..... 75/240
2005/0039574 A1 2/2005 Carpenter

FOREIGN PATENT DOCUMENTS

| | | |
|---|---|---|
| EP | 0 667 217 | 8/1995 |
| EP | 1 413 637 | 4/2004 |
| WO | WO 01/31075 | 5/2001 |
| WO | 2008/079083 | 7/2008 |

OTHER PUBLICATIONS

Communication pursuant to Article 94(3) EPC for European Patent Application No. 09 178 321.7, dated Apr. 24, 2013.

Notification of First Office Action (and English translation) for Chinese Patent Application No. 200910253770.6, dated May 16, 2013.

Extended European Search Report for European Patent Application No. 13156998.0, dated May 23, 2013.

* cited by examiner

*Primary Examiner* — George Wyszomierski
*Assistant Examiner* — Ngoclan T Mai
(74) *Attorney, Agent, or Firm* — Morgan, Lewis & Bockius LLP

(57) ABSTRACT

The present invention relates to a rotary cutter knife of a cemented carbide comprising a hard phase comprising WC and a binder phase wherein the cemented carbide comprises, in wt-%, from about 7 to about 12 Co+Ni, with a weight ratio Co/Ni of from about 0 to about 4, from about 0.5 to about 3 Cr and from about 0.1 to about 0.3 Mo.

22 Claims, 1 Drawing Sheet

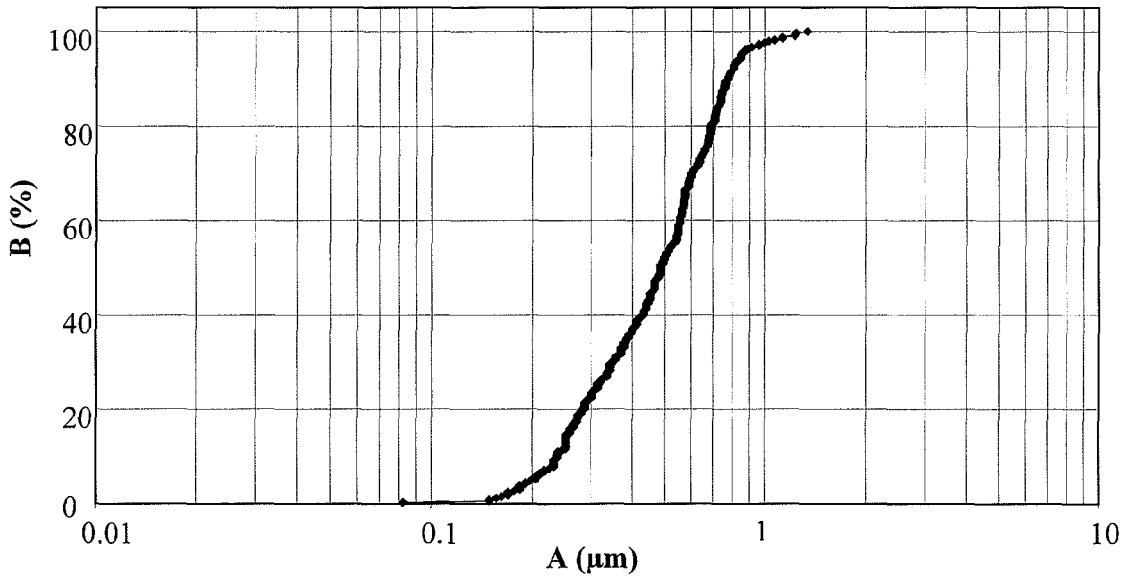
100
80
60
40
20
0
B (%)
0.01
0.1
1
10
A (μm)

ROTARY CUTTER KNIFE

CROSS-REFERENCE TO PRIOR APPLICATION

This application claims priority to Sweden Application No. 0802614-8 filed Dec. 18, 2008, which is incorporated by reference herein.

BACKGROUND OF THE INVENTION

The present invention relates to a carbide rotary cutter knife (CRC) for cutting composite materials used for female care and diaper products.

Typically, the rotation of a rotary cutter is in the order of 1000 rpm and its expected service life is around 10 million cuts before damage to the edge of the knife necessitates re-sharpening or replacement. The initial "airjack" pressure for contact between cutter and anvil is ~2 Bar. This is increased after several million cuts to compensate for slight wear and to get a clean cut, a maximum of 4 Bar also denotes extreme wear and the need to re-sharpen the knife.

The CRC system is a continuous process and therefore a reliable and predictable service life between re-sharpening intervals is essential.

OBJECTS AND SUMMARY OF THE INVENTION

It is an object of the present invention to provide a rotary cutter knife with improved performance.

In one aspect of the invention, there is provided a rotary cutter knife of a cemented carbide comprising a hard phase comprising WC and a binder phase wherein the cemented carbide comprises, in wt-%, from about 7 to about 12 Co+Ni, with a weight ratio Co/Ni of from about 0 to about 4, from about 0.5 to about 3 Cr and from about 0.1 to about 0.3 Mo.

In another aspect of the invention, there is provided the use of a rotary cutter knife as described above for rotary cutter applications in a corrosive-abrasive environment.

BRIEF DESCRIPTION OF THE DRAWING

FIG. 1 is a graph in logarithmic scale of the particle size distribution in the cemented carbide substrate.

DETAILED DESCRIPTION OF THE PREFERRED EMBODIMENTS

The present invention provides a rotary cutter knife of a cemented carbide with a hard phase comprising WC and a binder phase wherein the cemented carbide comprises, in wt-%, from about 7 to about 12 Co+Ni, preferably from about 8 to about 12 Co+Ni, with a weight ratio Co/Ni of from about 0 to about 4, from about 0.5 to about 3 Cr, preferably from about 0.5 to about 2 Cr, and from about 0.1 to about 0.3 Mo.

In one embodiment, the weight ratio Co/Ni in the binder phase is from about 0.25 to about 4.

In another embodiment, the weight ratio Co/Ni in the binder phase is from about 0 to less than about 0.25, preferably 0, i.e., Co is absent.

Preferably, essentially all WC grains have a size less than about 1 μm, meaning that preferably more than about 95%, preferably about 97%, of the WC grains have a size less than about 1 μm. Preferably the average WC grain size is less than about 1 μm, preferably less than about 0.7 μm.

It is an advantage if the binder phase contains between about 7 and about 14 wt-% Cr+Mo, preferably between about 8 and about 14 wt-% Cr+Mo, preferably between about 9 and about 13 wt-% Cr+Mo.

In one alternative embodiment, the binder phase contains between about 20 and about 24 wt-% Cr+Mo, preferably between about 21 and about 23 wt-% Cr+Mo.

It is preferred that the total carbon content is about 6.13−(0.05±0.01)×binder phase (Co+Ni) content in wt-%, that is, the total carbon content (wt-%) in the cemented carbide is preferably about 6.13−(0.05±0.01)×y, wherein y is the Co+Ni content in wt-%.

In one embodiment, the cemented carbide has a composition, in wt-%, from about 6 to about 8 Co, from about 2 to about 3 Ni, from about 0.8 to about 2 Cr, and from about 0.1 to about 0.3 Mo, with balance of WC.

In another embodiment, the cemented carbide has a composition, in wt-%, from about 3 to about 4 Co, from about 6 to about 8 Ni, from about 1 to about 1.5 Cr, and from about 0.1 to about 0.3 Mo, with balance of WC.

In another embodiment, the cemented carbide has a composition, in wt-%, from about 7 to about 10 Ni, preferably from about 8 to about 10 Ni, from about 0.5 to about 2 Cr, and from about 0.1 to about 0.3 Mo, with balance of WC.

In another embodiment, the cemented carbide has a composition, in wt-%, from about 9 to about 10 Ni, from about 2 to about 3 Cr, and from about 0.1 to about 0.3 Mo, with balance of WC.

The composite materials used in formulation of female care and diaper products and the like are nonwoven fibers with a special absorbent layer. It was found that together these materials, when containing high chloride content, glues and lotions that contain hard nano metallic oxide crystals, combine to form an abrasive-corrosive environment especially at the interface between the cutter knife edge and the anvil during the rotary cutting of product form. The rotary cutter knife is made of a cemented carbide with a specific binder design to get very good abrasion-corrosion resistance of the cemented carbide against the media being cut. In order to achieve good wear resistance and appropriate toughness, the cemented carbide grade preferably uses a submicron tungsten carbide and the binder content is high enough to keep a high toughness; For good resistance to corrosion resistance from the chlorides present, the binder is formulated from a 'stainless' alloy (see, e.g., Example 1).

The invention also relates to the use of a rotary cutter knife according to the invention for rotary cutter applications in a corrosive-abrasive environment. The rotary cutter provides with good resistance to hard particle abrasion under chloride acidic corrosion conditions.

The invention is additionally illustrated in connection with the following examples, which are to be considered as illustrative of the present invention. It should be understood, however, that the invention is not limited to the specific details of the examples.

EXAMPLE 1

Cemented carbide grades with the compositions in wt-% according to Table 1 were produced according to known methods and using WC powder with a FSSS grain size of 0.8 μm.

In certain embodiments of the invention, the sole components of the cemented carbide are those listed below along with any normal minor impurities.

The cemented carbide structure comprises WC with an average grain size of <1 μm, as measured using the linear intercept method, and has an actual particle size distribution as shown in FIG. 1 (A: grain size in μm; B: % cumulative number probability for the continuous distribution function). The actual average WC grain size of the cemented carbide is about 0.5 μm (see FIG. 1), The WC grain size and distribution have been measured by the linear intercept method according to ISO draft standard 4499-2:2008.

The material has a hardness of 1500-1800 HV30 depending on the selected composition.

The cemented carbide used in the present invention is prepared from powders forming the hard constituents and powders forming the binder are wet milled together, dried, pressed to bodies of desired shape and sintered.

Cemented carbide CRC bodies fabricated according to the invention composition was tested against the previous prior art for CRC standard cemented carbide (E) according to Table 1 below.

TABLE 1

(composition in wt-%)

| | A | B | C | D | E |
|---|---|---|---|---|---|
| Ref | | | | | |
| Sample | invention | invention | invention | invention | prior art |
| WC | Balance | Balance | Balance | Balance | Balance |
| Other | | | | | |
| Co | 6.6 | 3.5 | — | — | 10 |
| Ni | 2.2 | 7.0 | 8.0 | 9.5 | — |
| Cr | 1.0 | 1.3 | 0.7 | 2.5 | 0.43 |
| Mo | 0.2 | 0.2 | 0.2 | 0.2 | — |
| d WC(μm) | 0.8 | 0.8 | 0.8 | 0.8 | 0.8 |

Cemented carbide candidate grade test coupons were abrasion and corrosion tested according to ASTM standards G61 and G65 (including acidic media).

Other properties have been measured according to the standards used in the cemented carbide field, i.e., ISO 3369:1975 for the density, ISO 3878:1983 for the hardness and ASTM G65 for the abrasion wear resistance.

The corrosion resistance has been characterized according to ASTM61 standard particularly suited for measuring corrosion of (Co, Ni, Fe) in chloride solution.

It could also be that a synergistic effect takes place between the abrasive and corrosive mechanisms.

The results are presented in the Table 2 below.

TABLE 2

| Ref | A | B | C | D | E |
|---|---|---|---|---|---|
| Sample | invention | invention | invention | invention | prior art |
| Density | 14.45 | 14.6 | 14.6 | 14.2 | 14.5 |
| Hardness (HV30) | 1650 | 1550 | 1615 | 1600 | 1600 |
| Toughness (K1c) $MN/mm^{1.5}$ | 11.0 | 12.0 | 10.5 | 10.5 | 12.0 |
| Wear resistance volume loss ($mm^{-3}$) | 0.2 | 0.2 | 0.2 | 0.2 | 0.2 |
| Corrosion resistance* | 7.0 | 5.5 | | 8.0 | 2.3 |
| Performance lifetime million cuts | >20** | >20** | >20** | >20** | 10 |

*Breakdown potential according to ASTM61 with flushed port cell
Eb (10 $\mu A/cm^2$) normalized ranking scale 1-10 where Stainless316 = 10
**Estimated service life before re-sharpening Thus compared to prior art E, the invention exhibits improvements as shown below.

The corrosion resistance is increased by more than 2×.

The performance is estimated to increase from 10 million cuts to >20 million, that is, by more than ×2.

EXAMPLE 2

Performance tests were carried out using CRC manufactured from hardmetal according to composition as per invention ref. A. This cutter was subjected to production trials with 'ivory' media as part of controlled performance test and compared to standard cutter made from hardmetal according to prior art ref. E when cutting similar media.

The media consists of proprietary fabric layers containing high content of $CaCl^2$ that easily hydrates with water and moisture forming a slightly acidic electrolyte and is corrosive to (WC—Co) hardmetal. The media also comprises abrasive nanograin size metallic oxides, e.g., ZnO and $SiO^2$ contained in the Lotion between fabric layers.

Number of cuts for CRC manufactured from hardmetal according to composition as per invention ref. A: >60 million (at 1 million cuts per day) cutter still functioning well.

Number of cuts for CRC manufactured from standard hardmetal according to composition as per prior art ref E: <10 million (<10 days) before cutter needs regrinding.

The cutting lands for both cutters A, and E were examined under low power microscope ×200 for corrosion and abrasion wear.

Cutter as per invention ref A: no evidence of corrosion evident.

Cutter according to prior art ref E: showed considerable corrosion combined with carbide fracture and craters.

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

The invention claimed is:

1. A rotary cutter knife of a cemented carbide comprising a hard phase comprising WC and a binder phase, wherein the cemented carbide has a composition, in wt-%, from about 6 to about 8 Co, from about 2 to about 3 Ni, from about 0.8 to about 2 Cr, and from about 0.1 to about 0.3 Mo, with balance of WC.

2. A rotary cutter knife of a cemented carbide comprising a hard phase comprising WC and a binder phase, wherein the cemented carbide has a composition, in wt-%, from about 3 to about 4 Co, from about 6 to about 8 Ni, from about 1 to about 1.5 Cr, and from about 0.1 to about 0.3 Mo, with balance of WC.

3. A rotary cutter knife of a cemented carbide comprising a hard phase comprising WC and a binder phase, wherein the cemented carbide comprises, in wt-%, from about 7 to about 12 Co+Ni, with a weight ratio Co/Ni of from about 0 to about 4, from about 0.5 to about 3 Cr and from about 0.1 to about 0.3 Mo, and wherein essentially all WC grains have a size less than about 1 μm.

4. A rotary cutter knife according to claim 3 wherein the cemented carbide comprises, in wt-%, from about 8 to about 12 Co+Ni, and from about 0.5 to about 2 Cr.

5. A rotary cutter knife according to claim 3 wherein the cemented carbide has a composition, in wt-%, from about 7 to about 10 Ni, from about 0.5 to about 2 Cr, and from about 0.1 to about 0.3 Mo, with balance of WC.

6. A rotary cutter knife according to claim 5 wherein the cemented carbide comprises, in wt-%, from about 8 to about 10 Ni.

7. A rotary cutter knife according to claim 3 wherein the weight ratio Co/Ni is from about 0.25 to about 4.

8. A rotary cutter knife according to claim 3 wherein the weight ratio Co/Ni is from about 0 to less than about 0.25.

9. A rotary cutter knife according to claim 1 wherein the binder phase contains between about 7 and about 14 wt-% Cr+Mo.

10. A rotary cutter knife according to claim 9 wherein the binder phase contains between about 8 and about 14 wt-% Cr+Mo.

11. A rotary cutter knife according to claim 1 wherein a total carbon content, in wt-%, in the cemented carbide is about $6.13-(0.05\pm0.01)\times y$, wherein y is the Co+Ni content in wt-%.

12. A rotary cutter knife according to claim 1 wherein the average WC grain size is less than 1 μm.

13. A rotary cutter knife according to claim 2 wherein the binder phase contains between about 7 and about 14 wt-% Cr+Mo.

14. A rotary cutter knife according to claim 13 wherein the binder phase contains between about 8 and about 14 wt-% Cr+Mo.

15. A rotary cutter knife according to claim 2 wherein a total carbon content, in wt-%, in the cemented carbide is about $6.13-(0.05\pm0.01)\times y$, wherein y is the Co+Ni content in wt-%.

16. A rotary cutter knife according to claim 2 wherein the average WC grain size is less than 1 μm.

17. A rotary cutter knife according to claim 3 wherein a total carbon content, in wt-%, in the cemented carbide is about $6.13-(0.05\pm0.01)\times y$, wherein y is the Co+Ni content in wt-%.

18. A rotary cutter knife according to claim 3 wherein the binder phase contains between about 7 and about 14 wt-% Cr+Mo.

19. A rotary cutter knife according to claim 18 wherein the binder phase contains between about 8 and about 14 wt-% Cr+Mo.

20. A method of cutting composite materials, the method comprising:

supplying a composite material to a rotary cutter; and cutting the composite material with the rotary cutter, wherein the rotary cutter includes a rotary cutter knife according to claim 1, and wherein cutting of the composite material forms a corrosive-abrasive environment between the cutter knife edge and an anvil of the rotary cutter.

21. A method of cutting composite materials, the method comprising:

supplying a composite material to a rotary cutter; and cutting the composite material with the rotary cutter, wherein the rotary cutter includes a rotary cutter knife according to claim 2, and wherein cutting of the composite material forms a corrosive-abrasive environment between the cutter knife edge and an anvil of the rotary cutter.

22. A method of cutting composite materials, the method comprising:

supplying a composite material to a rotary cutter; and cutting the composite material with the rotary cutter, wherein the rotary cutter includes a rotary cutter knife according to claim 3, and wherein cutting of the composite material forms a corrosive-abrasive environment between the cutter knife edge and an anvil of the rotary cutter.

* * * * *